US007770596B2

(12) United States Patent
Christensen et al.

(10) Patent No.: US 7,770,596 B2
(45) Date of Patent: Aug. 10, 2010

(54) HYDRAULIC VALVE ARRANGEMENT

(75) Inventors: Thorkild Christensen, Soenderborg (DK); Siegfried Zenker, Kirchseeon (DE)

(73) Assignee: Sauer-Danfoss Aps, Nordborg (DK)

( * ) Notice: Subject to any disclaimer, the term of this patent is extended or adjusted under 35 U.S.C. 154(b) by 364 days.

(21) Appl. No.: 11/956,833

(22) Filed: Dec. 14, 2007

(65) Prior Publication Data

US 2008/0224073 A1 Sep. 18, 2008

(30) Foreign Application Priority Data

Dec. 20, 2006 (DE) ..... 10 2006 060 326

(51) Int. Cl.
*F15B 13/08* (2006.01)

(52) U.S. Cl. ..... 137/596; 137/884

(58) Field of Classification Search ..... 137/269, 137/271, 596, 884; 91/446, 447
See application file for complete search history.

(56) References Cited

U.S. PATENT DOCUMENTS 5,138,837 A * 8/1992 Obertrifter et al. ..... 137/596
5,579,642 A * 12/1996 Wilke et al. ..... 91/446
5,778,930 A * 7/1998 Friedrichsen et al. ..... 137/884
5,950,429 A 9/1999 Hamkins
6,318,079 B1 * 11/2001 Barber ..... 91/447
6,805,161 B2 * 10/2004 Zenker et al. ..... 137/596.2
6,854,270 B2 * 2/2005 Zenker et al. ..... 91/446
7,080,663 B2 7/2006 Kauss et al.
2001/0004032 A1 * 6/2001 Zenker et al. ..... 180/442
2003/0196545 A1 * 10/2003 Jensen et al. ..... 91/447
2003/0205279 A1 * 11/2003 Zenker et al. ..... 137/596.12
2004/0099316 A1 5/2004 Koetter
2004/0216599 A1 * 11/2004 Pieper ..... 91/446
2005/0257519 A1 * 11/2005 Jensen et al. ..... 91/447
2008/0223456 A1 * 9/2008 Christensen et al. ..... 137/493
2008/0245222 A1 * 10/2008 Christensen et al. ..... 91/418

FOREIGN PATENT DOCUMENTS

DE 69822109 T2 6/1999

* cited by examiner

*Primary Examiner*—John Rivell
(74) *Attorney, Agent, or Firm*—McCormick, Paulding & Huber LLP

(57) ABSTRACT

The invention concerns a hydraulic valve arrangement (1) with several valve modules (2-6), each having a supply channel arrangement with a high-pressure channel (7) and a low-pressure channel (8), a working connection arrangement with at least one working connection (A, B), a directional valve arrangement (15, 16) between the supply channel arrangement and the working connection arrangement and a compensation arrangement (19, 28). It is endeavoured to improve the control possibilities. For this purpose, it is provided that in at least one valve module (3, 5) the compensation arrangement is a pre-compensation arrangement (19) and in at least one other valve module (4, 6) the compensation arrangement is a post-compensation arrangement (28).

7 Claims, 1 Drawing Sheet

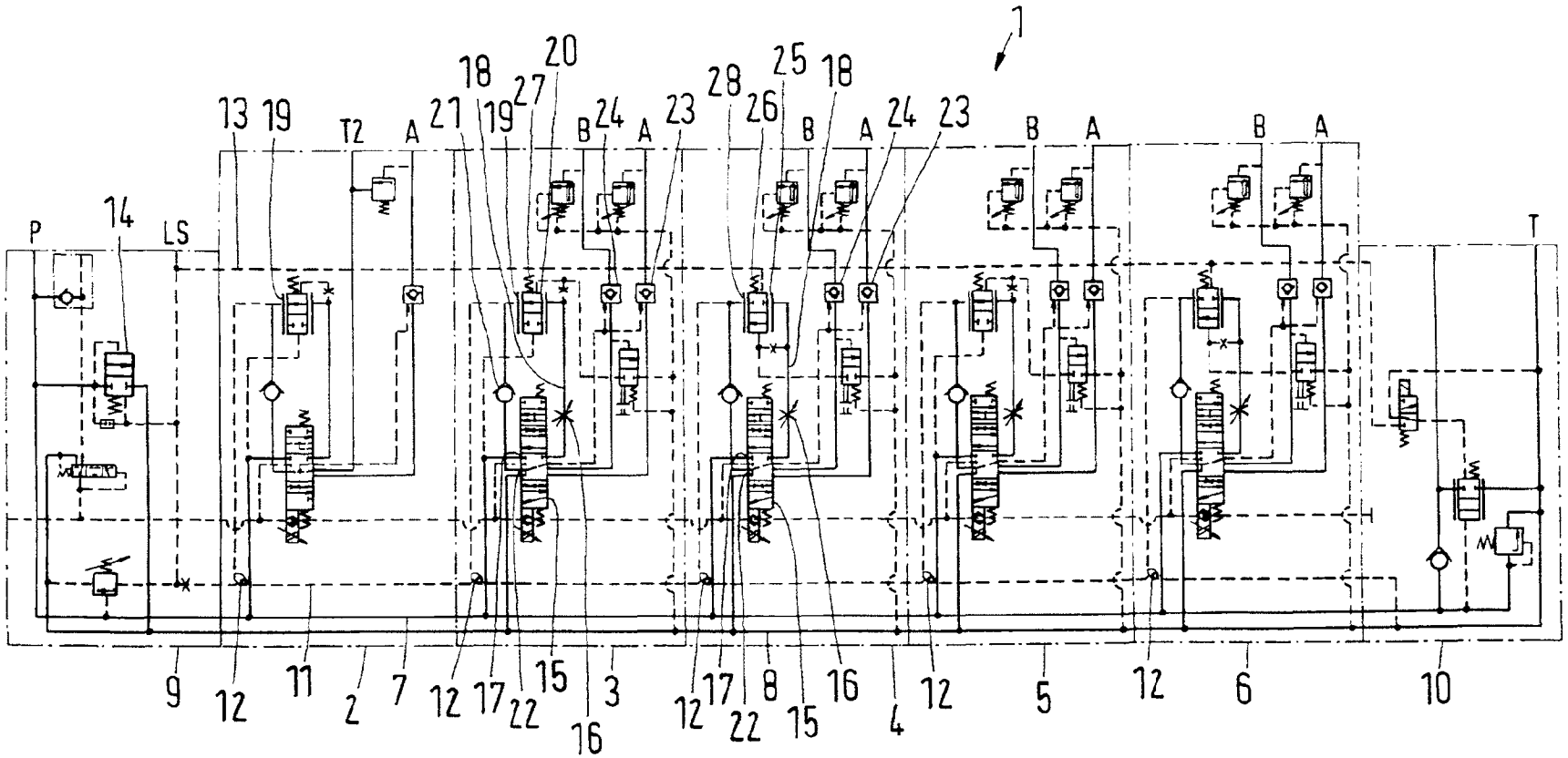
1
T
10
A
B
6
12
5
4
23
24
18
25
26
28
16
15
8
22
17
3
20
27
19
21
7
2
T2
11
13
LS
9
14
P

HYDRAULIC VALVE ARRANGEMENT

CROSS REFERENCE TO RELATED APPLICATION

Applicant hereby claims foreign priority benefits under U.S.C. §119 from German Patent Application No. 10 2006 060 326.5 filed on Dec. 20, 2006, the contents of which are incorporated by reference herein.

FIELD OF THE INVENTION

The invention concerns a hydraulic valve arrangement with several valve modules, each having a supply channel arrangement with a high-pressure channel and a low-pressure channel, a working connection arrangement with at least one working connection, a directional valve arrangement between the supply channel arrangement and the working connection arrangement and a compensation arrangement.

BACKGROUND OF THE INVENTION

Such a valve arrangement is used in many cases to actuate hydraulic drives in a working machine, a vehicle or another arrangement. For example in a backhoe, a first hydraulic drive can be used to tilt a beam in relation to a chassis, a second hydraulic drive can be used to tilt an arm in relation to the beam and a third hydraulic drive can be used to activate a shovel. A fourth hydraulic drive can be provided to turn the upper vehicle body in relation to the lower vehicle body.

In this connection, the use of a compensation arrangement has the advantage that a load-pressure independent control is obtained. The compensation arrangement ensures that a pressure drop over the directional valve arrangement or over a measuring orifice combined with the directional valve arrangement remains constant, independently of the intensity of the working pressure and independently of the opening degree of the directional valve arrangement. Thus, the flow of the hydraulic fluid from the supply channel arrangement to the connected hydraulic drive basically only depends on the opening degree of the directional valve arrangement. Thus, a practically proportional function of the directional valve arrangement is obtained.

In principle, there are two different ways of designing a compensation arrangement. A first compensation arrangement, in the following called "pre-compensation arrangement", has a compensation valve that is flow-technically located upstream of the measuring orifice mentioned above. The compensation device has a throttle slide that is acted upon in the closing direction by the pressure upstream of the measuring orifice and in the opening direction by the pressure downstream of the measuring orifice, that is, by the load pressure plus the pressure of a spring. Such a compensation arrangement is occasionally also called a "primary individual compensation valve".

Another embodiment, in the following called "post-compensation arrangement, uses a compensation valve that is connected in the flow direction downstream of the measuring orifice. The throttle slide in the downstream located compensation valve is acted upon in the opening direction of the pressure down-stream of the measuring orifice and in the closing direction by the highest load pressure and a spring.

With a valve module with post-compensation arrangement a parallel activation of two or more valve modules and an insufficient supply of hydraulic fluid will cause a uniform reduced fluid flow via all measuring orifices. The available fluid flow will thus be distributed proportionally to all drives. This is not possible with a valve module with a pre-compensation arrangement.

SUMMARY OF THE INVENTION

The invention is based on the task of improving the control possibilities of a valve arrangement.

With a hydraulic valve arrangement as mentioned in the introduction, this task is solved in that in at least one valve module the compensation arrangement is a pre-compensation arrangement and in at least one other valve module the compensation arrangement is a post-compensation arrangement.

With this embodiment, during insufficient supply, the drive or the drives connected to the valve module or valve modules with pre-compensation arrangement can be controlled differently than the drives connected to valve modules with post-compensation arrangement. With the example mentioned above of a backhoe with several drives, the drive turning the upper vehicle body in relation to the lower vehicle body can, for example, be connected to a pre-compensated valve module, whereas the other drives that activate the shovel, the arm and the beam can be connected to post-compensated valve modules. If all drives are then activated at the same time, an insufficient supply will probably occur. This insufficient supply will then be distributed differently than usual. The turning drive will practically not be affected by the insufficient supply. The upper vehicle body will continue to turn at the speed wanted by the user. The remaining drives receive the rest of the hydraulic fluid, which will then be distributed proportionally to the individual positions of the directional valves. Many users find such control behaviour more comfortable. Of course, also other examples can be imagined, in which pre-compensated valve modules and post-compensated valve modules are mixed in a valve arrangement with several valve modules.

Preferably, the post-compensation arrangement has a closing spring and the pre-compensation arrangement has an opening spring, the closing spring being weaker than the opening spring. In the post-compensation arrangement the closing spring acts together with the pressure in a load sensing pipe. The pressure behind the measuring orifice acts in the opening direction. With a pre-compensated valve, however, the spring acts in the opening direction, and the pressure before the measuring orifice acts in the closing direction. The mentioned dimensioning of the springs ensures in a simple manner that the pre-compensated valve module will always have priority over the post-compensated valve module or valve modules.

Preferably, the opening spring generates a control force, which is smaller than a pressure force during idling, which acts against the opening spring. Thus, an energy-saving behaviour of the pre-compensated valve module can be achieved. Particularly, if the pressure ruling in the high-pressure channel is reduced during idling by a variable displacement pump or another control device, the pre-compensated valve can close or at least throttle heavily to interrupt a possible volume flow.

Preferably, in the valve module with the pre-compensation arrangement, the compensation arrangement is located in a pipe that extends from an outlet to an inlet of the directional valve arrangement. The pre-compensation arrangement is thus physically located after the directional valve arrangement and thus also after the measuring orifice. When activated, the directional valve arrangement then releases a flow path for hydraulic fluid from the high-pressure channel to the inlet of the pre-compensation arrangement.

It is preferred that both the pre-compensation arrangement and the post-compensation arrangement are located in pipes extending from an outlet to an inlet of the directional valve arrangement. Thus, the designs of a pre-compensated valve module and a post-compensated valve module can approach each other. The costs of manufacturing are reduced.

It is particularly preferred that the compensation arrangements are located in the same position in both valve modules with pre-compensation arrangements and in valve modules with post-compensation arrangements. This permits an even further approach of the design correlation between the valve module with pre-compensation arrangement and the valve module with post-compensation arrangement.

In a particularly preferred embodiment it is provided that both the valve module with pre-compensation arrangement and the valve module with post-compensation arrangement have similar valve housings and that a spring of the pre-compensation arrangement is located at a different side of a slide than a spring of the post-compensation arrangement. This keeps the costs of manufacturing a valve arrangement low, also if valve modules with different control behaviours are used. The same valve housings can be used for both pre-compensation and post-compensation. These valve housings merely have to have a few more channels than would be required, if the valve housings were only meant for one function. The superfluous channels can simply be closed with plugs. This is more cost effective than providing different valve housings for the two functionalities.

BRIEF DESCRIPTION OF THE DRAWINGS

In the following the invention will be described on the basis of a preferred embodiment in connection with the drawing, showing:

Only FIGURE is a schematic view of a hydraulic valve arrangement.

DETAILED DESCRIPTION OF THE PREFERRED EMBODIMENTS

A hydraulic valve arrangement 1 has several valve modules 2-6. The valve modules 2-6 are flanged together in a block. A high-pressure channel 7 and a low-pressure channel 8, forming the supply channel arrangement, are led through the block.

An inlet module 9 is flanged onto one side of the block of valve modules 2-6, and an end module is flanged onto the opposite end. The inlet module 9 has a pressure connection P that is connected to the high-pressure channel. The end module has a connection T that is connected to the low-pressure channel. The high-pressure channel P can be connected to a pump or another pressure source. The low-pressure connection T is connected to a tank or another container. Further, the inlet module 9 has a load-sensing connection LS, which carries the highest load pressure ruling in the valve modules 2-6. A corresponding load pressure channel 11 also extends through all valve modules 2-6. In the end module 10 it is connected to the low-pressure pipe 8. Two-way valves 12 form a cascade in the load sensing channel 11. They pass on the higher pressure at the inlets to their outlet, so that in the inlet module 9 the load pressure channel 11 carries the higher pressure ruling in all valve modules 2-6.

The load pressure channel 11 has a section in the form of a load-sensing pipe 13, which also extends through all valve modules 2-6.

In the inlet module 9 is provided an inlet compensation valve 14, which ensures that the pressure in the high-pressure channel 7 always exceeds the pressure in the load-sensing channel 13 by an at least substantially constant value.

The valve module 2 has a working connection A and a further connection T2. The working connection A can be supplied with pressurised hydraulic fluid, whereas the connection T2 can not. Accordingly, a single-acting hydraulic drive can be connected to the valve module 2, said drive merely serving the purpose of lifting a load. The hydraulic volume displaced from the hydraulic drive during lifting of the load can then be adopted and discharged by the valve module 2 via the T2-connection. During lowering of the load hydraulic fluid can be replenished via the T2-connection.

Each of the other valve modules 3-6 has two working connections A, B, which can, as will be explained below, be pressurised in a controlled manner.

The valve modules 3 and 5 are designed in the same way. Both have a directional valve 15 connected in series with a measuring orifice 16. The measuring orifice 16 can, of course, also be part of the directional valve 15. Therefore, the combination of measuring orifice 16 and directional valve 1 is called directional valve arrangement.

Via an inlet 17 the directional valve 15 is connected to the high-pressure channel 7. An outlet 18 of the directional valve arrangement 15, 16 leads to a compensation valve 19, which has a compensation slide 20 being acted upon in the opening direction by an opening spring 27 and in the closing direction by the pressure in the high-pressure channel 7. Further, the pressure at the outlet 18 of the directional valve arrangement 15, 16 acts in the opening direction, so that the compensation slide always adjusts so that the pressure over the measuring orifice 16 corresponds to the force of the opening spring 27.

Via a non-return valve 21 opening in the direction of the directional valve 15, the compensation valve 19 is connected to an inlet 22 of the directional valve 15, said inlet being connectable to one of the working connections A, B in dependence of the activation of the directional valve 15. Non-return valves 23, 24, which can be opened, are located before the working connections A, B, said non-return valves enabling a drop-tight connection of the hydraulic machines.

As the compensation valve 19 is controlled by the pressure before the measuring orifice 16, it is also called pre-compensation valve. The valve modules 3, 5 can also be called "pre-compensated" valve modules.

The valve modules 4, 6 also have the same design. Also here a directional valve 15 and a measuring orifice 16 are provided, which together form a directional valve arrangement. The inlet of the directional valve 15 is connected to the high-pressure channel 7.

To the outlet 18 of the directional valve arrangement 15, 16 is also connected a compensation valve 28, whose compensation slide 25 is acted upon in the closing direction by a closing spring 26. In the closing direction also the pressure at the load-sensing connection LS acts that is passed on to here via the load-sensing pipe 13. In the opening direction the pressure at the outlet 18 of the directional valve arrangement 15, 16 acts upon the compensation slide 25.

The outlet of the compensation valve 28 is connected to the inlet 22 of the directional valve 15. In dependence of its position, the directional valve 15 can connect this inlet 22 to one of the working connections A, B, non-return valves 23, 24 that can be opened also being provided here to prevent a leakage at the working connections A, B.

As the compensation valve 28 is controlled by the pressure after the measuring orifice 16, it is also called "post-compensation valve". Accordingly, the valve modules 4, 6 are "post-compensated" valve modules.

The valve module 2 also has a pre-compensation valve 19.

A pre-compensated valve module 3, 5, whose directional valve arrangement 15, 16 can then also be called LS-valve with primary, individual compensation valve, enables no supply-dependent distribution of the available flow of hydraulic fluid. When several such valve modules in parallel operation control their drives at the same time, the drive with the lowest load-pressure will be the first to be supplied with hydraulic fluid, whereas the remaining volume flow will be led to the other drives. In the end this causes that during an insufficient supply the function of the drive with the smallest load will be maintained, whereas another drive with a larger load will stop.

A post-compensated valve module 4, 6, however, permits the distribution of the flow of hydraulic fluid proportionally to the positions of the individual directional valve arrangements 15, 16. A post-compensated valve module can also be called an "LC valve".

The closing spring 26 in the post-compensated valve modules 4, 6 is weaker than the opening spring 27 in the pre-compensated valve modules 3, 5. In this way, it is ensured that the pre-compensated valve modules 3, 5 always have priority over the post-compensated valve modules 4, 6. Therefore, during an insufficient supply the drives connected to the pre-compensated valve modules 3, 5 will be activated first. The drives connected to the post-compensated valve modules 4, 6, however, reduce their working speed proportionally.

The proportional reduction of the volume flow with post-compensated valves is mainly caused by the drop of the "margin pressure" that reduces the opening force at the compensator, whereas nothing changes on the spring side. With post-compensated valves this drop has an immediate effect, whereas with pre-compensated valves the effect does not occur until the "margin pressure" drops below the spring value of the opening spring.

Preferably, the opening spring 27 can be made so that the pressure it provides is smaller than an idling pressure in the high-pressure channel 7, which can also be called "stand-by pressure" or "margin pressure. This enables an energy-saving operation.

As can be seen from the schematic view, the piping and the location of the individual elements in the pre-compensated valve modules 3, 5 is substantially equal to the corresponding piping and locations of the elements in the post-compensated valve modules 4, 6. This applies, as can be seen clearly, for the path from the directional valve 15 to the working connections A, B, including the non-return valves 23, 24 that can be opened.

The location of the compensation valves 19, 28, however, is the same in both valve module kinds. Merely the closing spring 26 of the compensation slide 25 must be moved to the other side of the compensation slide 25 to make a pre-compensated compensation slide 20. Further, it is merely required to remove the pipe existing between the compensation slide 25 and the load-sensing pipe 13 and to replace it by a pipe between the inlet 17 of the directional valve 15 and the compensation slide 20. In principle, it is therefore sufficient to provide corresponding bores in the housing for both of these pipes and then close those bores by means of plugs or the like.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A hydraulic valve arrangement with several valve modules, each having a supply channel arrangement with a high-pressure channel and a low-pressure channel, a working connection arrangement with at least one working connection, a directional valve arrangement between the supply channel arrangement and the working connection arrangement and a compensation arrangement, wherein in at least one valve module the compensation arrangement is a pre-compensation arrangement and in at least one other valve module the compensation arrangement is a post-compensation arrangement.

2. The valve arrangement according to claim 1, wherein the post-compensation arrangement has a closing spring and the pre-compensation arrangement has an opening spring, the closing spring being weaker than the opening spring.

3. The valve arrangement according to claim 2, wherein the opening spring generates a control force, which is smaller than a pressure force during idling, which acts against the opening spring.

4. The valve arrangement according to claim 1, wherein in the valve module with the pre-compensation arrangement, the compensation arrangement is located in a pipe that extends from an outlet to an inlet of the directional valve arrangement.

5. The valve arrangement according to claim 4, wherein both the pre-compensation arrangement and the post-compensation arrangement are located in pipes extending from an outlet to an inlet of the directional valve arrangement.

6. The valve arrangement according to claim 5, wherein the compensation arrangements are located in the same position in both valve modules with pre-compensation arrangements and in valve modules with post-compensation arrangements.

7. The valve arrangement according to claim 1, wherein both the valve module with pre-compensation arrangement and the valve module with post-compensation arrangement have similar valve housings and that a spring of the pre-compensation arrangement is located at a different side of a slide than a spring of the post-compensation arrangement.

* * * * *